United States Patent [19]

Denny et al.

[11] Patent Number: 4,684,366

[45] Date of Patent: Aug. 4, 1987

[54] SYRINGE FOR THE REMOTE INJECTION OF ANIMALS AND FISH

[76] Inventors: Christopher G. Denny; Brian J. Harvey, both of 1175B Newport Avenue, Victoria, B.C., Canada, V8S 5E6

[21] Appl. No.: 776,673

[22] Filed: Sep. 16, 1985

[30] Foreign Application Priority Data

Mar. 15, 1985 [CA] Canada ..... 476641

[51] Int. Cl.[4] ..... A61M 5/00

[52] U.S. Cl. ..... 604/130; 604/139; 604/143; 273/418; 43/43.13

[58] Field of Search ..... 604/143, 148, 139, 130; 43/43.13; 273/418

[56] References Cited

U.S. PATENT DOCUMENTS

| | | | |
|---|---|---|---|
| 2,168,437 | 8/1939 | Buercklin | 604/143 |
| 2,744,527 | 5/1956 | Barret et al. | 128/216 |
| 3,207,157 | 9/1965 | Murdoch | 604/130 |
| 3,359,979 | 12/1967 | Murdoch | 604/143 X |
| 3,433,223 | 3/1969 | Black | 128/218 |
| 3,563,373 | 2/1971 | Paulson | 206/63.2 |
| 3,605,744 | 9/1971 | Dwyer | 604/139 |
| 3,721,241 | 3/1973 | Klohr et al. | 128/221 |
| 3,939,833 | 2/1976 | Hansson et al. | 128/218 P |
| 4,178,928 | 12/1979 | Tischlinger | 604/139 |
| 4,333,456 | 6/1982 | Webb | 128/218 R |
| 4,378,015 | 3/1983 | Warcklaw | 128/218 F |
| 4,390,016 | 6/1983 | Riess | 604/236 |
| 4,394,863 | 7/1983 | Bartner | 604/90 |
| 4,447,231 | 5/1984 | Bekkering | 604/131 |

FOREIGN PATENT DOCUMENTS

| | | | |
|---|---|---|---|
| 1048066 | 11/1966 | United Kingdom | 604/130 |

OTHER PUBLICATIONS

Haigh and Hopt. The Blowgun in Veterinary Practice: Its Uses and Preparation, J. Am. Vet. Med. Assoc. 169, 881–883 (1976).

Bernard & Dobbs, A Handmade Blowgun Dart: Its Preparation and Application in a Zoological Park, J. An. Vet. Med. Assoc. 1977, 951–954 (1980).

Jones, An Assessment of Weapons and Projectile Syringes Used for Capturing Mammals, Vet. Record 250–253 (Sep. 1976).

Fletcher et al., Butane Powered Injection by Pole Syringe, J. Zoo Anim. Med., 10, 106–112 (1979).

Harthoorn, The Chemical Capture of Animals, Balliere Tindall (London) 1976.

Wentges, Medicine Adinistration by Blowpipe, Veterinary Records 281 (Oct. 1975).

Warren et al., A Modified Blow-Gun Syringe for Remote Injection of Captive Animals, J. Wildlife D.S., 15, 537–541 (1979).

*Primary Examiner*—Stephen C. Pellegrino

*Attorney, Agent, or Firm*—Spensley Horn Jubas & Lubitz

[57] ABSTRACT

A novel syringe is provided herein. It includes a cylindrical barrel having a closed forward end provided with a longitudinally-extending channel therethrough. A hypodermic needle is slidably received in the channel. A frangible septum is disposed in the channel and is adapted to be pierced upon inward sliding movement of the hypodermic needle. At least a single stopper is slidably and sealingly disposed in the barrel to divide the barrel into (i) a forward, payload chamber, defined between the closed forward end of the barrel and the leading face of the stopper, and (ii) a rearward propulsion chamber downstream of the trailing face of the stopper. The propulsion chamber is controllably variably prechargeable to a predetermined gaseous pressure. The syringe may be used with a novel retractable collar and with a novel sliding fin assembly. This syringe allows injection, from a distance, of aquatic or land animals with tranquillizers, medications, or other chemical compounds without entrapment and stressing of the animal. A variation of this syringe is taught herein to allow the remote tranquillization and entrapment of aquatic animals where the animals may not be visibly selected.

8 Claims, 15 Drawing Figures

SYRINGE FOR THE REMOTE INJECTION OF ANIMALS AND FISH

BACKGROUND OF THE INVENTION (i) Field of the Invention

This invention relates to a remote injector structure to deliver at least one chemical compound into or onto animals or any other living creature or inanimate object while the operator is at a distance therefrom.

(ii) Description of the Prior Art

The art is replete with remote injection devices of the general nature described above. In some of these devices, the charge is disposed in a sealed chamber, one end of which is ruptured by a slidable hollow needle, to allow the charge to be propelled out from the hollow needle into the animal struck by the needle. The art was concerned mainly with the means for propelling the charge out from the hollow needle, when the sealed chamber was pierced. In other of these devices, the charge was expelled upon impact-triggered detonation of an explosive charge.

Among the patents providing such propulsion means are the following:

U.S. Pat. No. 1,815,300 patented July 21, 1931, by B. W. Harris,

U.S. Pat. No. 1,819,415 patented Aug. 18, 1931, by B. Harris,

U.S. Pat. No. 2,617,359, patented Nov. 11, 1952, by G. E. Van Horn et al,

U.S. Pat. No. 2,854,925, patented Oct. 7, 1958, by J. A. Crocksford et al,

U.S. Pat. No. 2,923,243, patented Feb. 2, 1960, by J. A. Crocksford et al,

U.S. Pat. No. 2,995,373, patented Aug. 8, 1961, by J. R. Cox,

U.S. Pat. No. 3,093,077, patented June 11, 1963, by L. B. Harris,

U.S. Pat. No. 3,209,695, patented Oct. 5, 1965, by J. A. Crosksford et al,

U.S. Pat. No. 3,209,696, patented Oct. 5, 1965, by H. C. Palmer et al, (corresponding to Canadian Patent No. 790,342, patented July 23, 1968), U.S. Pat. No. 3,396,660, patented Aug. 13, 1968, by F. L. Bilson et al, U.S. Pat. No. 3,584,582, patented June 15, 1971, by C. Muller, U.S. Pat. No. 3,701,533, patented Oct. 31, 1972, by H. C. Palmer, U.S. Pat. No. 3,715,990, patented Feb. 13, 1973, by H. C. Palmer, U.S. Pat. No. 3,837,284, patented Sept. 24, 1974, by R. B. Walderson, and U.S. Pat. No. 3,901,158 patented Aug. 26, 1975 by T. E. Ferb.

These patents, while providing propulsion means, nevertheless raised many problems. One problem was inherent in the provision of an explosive cap or charge which could deteriorate on storage or exposure to moisture and thus be inoperative. The use of such explosive caps or charges also made it impossible to alter injection pressure. No provision was made for variable precharging of the prupulsion chamber prior to firing the device. Moreover, many of the proposed devices were difficult to manufacture due to the complexity of the structure. In all these devices of the prior art, the injection pressure was not finely controllable. Furthermore, in the case of the explosive device, injection was made with great and unalterable force, resulting in tissue damage that was poorly tolerated by smaller specimens.

A salient feature of these devices was that they were designed especially for remote injection of terrestial animals. No similar device exists for remote injection, in aquatic animals, of an intramuscular or intraperitoneal dose of a tranquillizing agent or other chemical as is commonly done with terrestrial animals, while insuring a minimum of damage to the animal. U.S. Pat. No. 3,340,642 patented Sept. 12, 1967 by T. P. Vasiljevic, provided injection of poisons into aquatic animals or fish whose purpose was to kill the target animal. Even if no poison were used in that device, however, the barbs which were employed would cause intolerable tissue damage.

Sedation and/or anesthesia of fish has hitherto been possible only by direct topical application of a strong solution of an anesthetic (by squirting the anesthetic solution in their immediate vicinity), or by complete immersion in a solution of the anesthetic. Drawbacks of the former method are waste of materials, hazard to human health, damage to non-target species and lack of efficiency with many species. Drawbacks of the immersion technique include waste of materials, necessity for entrapment before anesthesia (with resulting stress), and risk of contact dermatitis in humans exposed to solutions of the commonly used anethetics, e.g. tricaine methane sulfonate, quinaldine, or 2-phenoxyethanol. In the case of aquatic mammals, e.g. seals, standard parenteral anesthesia techniques must be preceded by entrapment, a procedure that is highly stressful.

A problem inherent in the remote injection of aquatic animals is associated with the travel of a spear gun shaft through the water. Such travel is known to be inherently unpredicatable because of the weight and resistance of the spear point. Devices have been patented in an attempt to solve the problem of true flight of such a device through the water. One such patented device was provided in U.S. Pat. No. 3,340,642, patented Sept. 12, 1967 by T. P. Vasiljevic, which taught a spear assembly in which the stability of flight in water was improved by a collar including radially-outwardly-extending fins which were slidably and non-rotationally received on the spear rod. Two problems inherent in this patented device are that the eccentricity, e.g. key and keyway, necessary to align travel of the fins results in dynamic unbalance, and that an alternative flat surface method of keyway would be ineffective in practice as the sliding fin would tend to bind.

There is therefore a need for means to capture aquatic animals from the wild without causing mechanical damage or physiological stress. Coupled with this need is a need for a means to inject a tranquillizer, antibiotic, hormone or other chemical compound into an aquatic or land animal without entrapment or handling of the animal and without causing undue tissue damage. It would be desirable to provide such means with a releasing device that will automatically detach the injection device from the animal after injection is complete. It would similarly be desirable to provide a device that could allow quick and complete detachment of the injection device from a handle, prod, or spear gun shaft, thus allowing the injection device to remain attached to the animal at least until injection is complete. The injecting means should also preferably include means to mark or otherwise identify animals, especially those that have been treated with the injection device. In view of its use underwater, it would also be desirable to provide an associated means to ensure a straighter trajectory of spear gun shafts, especially when they are fitted with special purpose points, e.g. an injection syringe and delivery mechanism.

SUMMARY OF THE INVENTION (i) Aims of the Invention

A broad object of the present invention is to provide a device especially adapted for the remote injection of any chemical agent into an aquatic or land animal.

Another object of this invention is the provision of a device that is simple and reliable and does not employ chemical reagents that may deteriorate or otherwise cause malfunction, or explosive charges that need to be inserted and in which the chemical agent is expelled with uncontrollable force.

Yet another object of this invention is the provision of such a device which is adjustable both in the quantity of injectible chemical agent and the pressure of propellant gas to facilitate injecting the animals with the desired quantity of chemical compound.

Yet another object of this invention is the provision of a device which includes means for applying a marker, e.g. a dye, to a live or inanimate target to indicate whether the target has been hit or injected, or to mark such a target as an end in itself.

A more specific object of this invention is to provide a syringe and needle combination capable of reliable automatic injection of an aquatic or land animal on impact or momentary applied pressure, either in air or underwater.

A further specific object of this invention is to provide an automatic syringe and releasing needle combination with subsequent release of the entire injection device from an aquatic animal after injection has taken place.

Another specific object of this invention is to provide an automatic syringe capable of travelling in as straight a trajectory as possible after being shot from a gun or from a blowgun.

Yet another specific object of this invention is to provide a device to hold the syringe on the end of a prod or handle which will allow quick and complete detachment from the syringe on impact with an animal.

Another more specific object of this invention is to provide a device to attach to a spear gun shaft which will hold a syringe as it is being shot toward an aquatic animal and will quickly and completely disconnect the spear gun shaft from the syringe as soon as the animal is struck, allowing the animal to move away freely with the syringe only attached.

Yet another specific object of this invention is to provide a device which will ensure straighter trajectory flight of of spear gun shafts, especially when used in combination with special purpose spear points.

A further specific object of this invention is to provide a device which will allow automatic tranquillization of an aquatic animal or fish subsequent to the aquatic animal or fish "taking" a baited hook or lure, to prevent the aquatic animal or fish from being stressed due to fighting retrieval.

(ii) Statement of Invention

The present invention provides the following, namely: two novel syringes; a novel fixed syringe needle; a novel releasing syringe needle; a novel retracting collar, which may desirably be used with, and in combination, with such syringes; a novel device for delivering chemical compounds to the vicinity of aquatic animals or fish; and a novel sliding fin assembly useful per se with a spear shaft but also especially useful in combination with the novel retracting collar and the novel above-referred-to syringes.

The invention first of all provides a syringe comprising: a barrel preferably cylindrical having a closed forward end provided with a longitudinally-extending channel therethrough; a hypodermic needle slidably received in the channel; a frangible septum disposed in the channel and adapted to be pierced upon inward sliding movement of the hypodermic needle; and at least a single stopper slidably and sealingly disposed in the barrel to divide the barrel into (i) a forward, payload chamber, defined between the closed forward end of the barrel and the leading face of the stopper, and (ii) a rearward propulsion chamber downstream of the trailing face of the stopper, the propulsion chamber being controllably, variably, prechargeable to a predetermined gaseous pressure.

This invention also provides a retractable collar comprising: a collar chamber having an open forward end and an open base provided with an internal peripheral flange; a shaft projecting through the open base of the chamber; a plunger disposed in the collar chamber and secured to the forward end of the shaft; recoil means disposed within the collar chamber between the plunger and the internal peripheral flange; a plurality of integral triggers adjacent the forward end of the collar chamber, the triggers being integrally and springingly associated with the collar chamber; means associated with the triggers for urging the triggers outwardly upon longitudinal movement of a suitably-shaped cooperating plunger member within the collar chamber; and encircling, retaining means urging the triggers radially inwardly, while allowing the triggers to be forced radially outwardly, but serving to return the triggers to their rest orientation thereby firmly to hold the cooperating member in place.

This invention also provides the combination of the above-identified retracting collar with the syringes of the embodiments of the present invention described above. Provided by this invention also, is the combination of the syringes of embodiments of the present invention, in which the barrel of such syringe is operatively connected to, and is concentrically disposed within, the collar chamber of the retractable collar of an embodiment of this invention.

This invention also provides a sliding fin assembly for the shaft of a spear gun, the fin assembly comprising the combination of: a cylindrical spear gun shaft; a stop ring at one end thereof; a tubular collar freely slidably mounted on the shaft; a plurality of fins projecting equiangularly about the collar; a bridle comprising a plurality of lines equal in number to the plurality of fins, each line being connected both to an associated fin and to a common swivel; and a lanyard for connection from the common swivel to the spear gun.

This invention also provides the combination of the above-described sliding fin assembly with the syringes of embodiments of this invention and with the retracting collar of an embodiment of this invention. Provided by this invention, then, is the combination of the syringes of embodiments of the present invention in which the barrel of the syringe is operatively connected to, and is concentrically disposed within, the collar chamber of the retractable collar of an embodiment of the present invention, and in which the trailing end of the shaft of the retractable collar cosists of the cylindrical shaft of the sliding fin assembly of an embodiment of the present invention.

The present invention also provides a device for delivering a chemical compound orally to an aquatic animal or to a fish. The device comprises the combination of the syringes of embodiment of the present invention with a sleeve secured to an operating fish line for holding the syringe in an inverted position with the outer point of the needle projecting through, and fixed within, an aperture in the base of the sleeve, the sleeve including a plurality of longitudinal slots therein; an operating yoke provided with a prong associated with each such longitudinal slot, each prong abutting the inverted end of the syringe; a fish hook or lure secured to the lower end of the operating yoke and associated with a delivery means permitting expulsion of the contents of the syringe in the vicinity of the hook upon downward movement of the yoke resulting in puncture of the septum in the syringe.

(iii) Other Features of the Invention

In one specific feature of the syringe of this invention, a single stopper is provided which is slidably and sealingly disposed in the barrel, the stopper comprising a forward plug terminating in a cylindrical deformable skirt, the skirt being provided with a plurality of longitudinally-spaced-apart, external, projections; the stopper dividing the barrel into (i) a forward, payload chamber, defined between the closed forward end of the barrel and the leading face of the stopper, and (ii) a rearward propulsion chamber defined between the trailing face of the stopper and the closed rear end of the barrel; the propulsion chamber being controllably, variably, prechargeable to a predetermined gaseous pressure.

In a second specific feature of the syringe of this invention, two stoppers are provided, namely a forward stopper slidably and sealingly disposed in the barrel, the forward stopper comprising a forward plug terminating in a cylindrical deformable skirt, the skirt being provided with a plurality of longitudinally-spaced-apart, external, projections; and a rear stopper, slidably and sealingly disposed within the barrel and retainable adjacent the open end of the barrel by a retaining ring, the forward stopper and the rear stopper together thereby dividing the barrel into (i) a forward, payload chamber, defined between the closed forward end of the barrel and the leading face of the forward stopper, and (ii) a rearward propulsion chamber, defined between the trailing face of the forward stopper and the leading face of the rear stopper, the propulsion chamber being controllably, variably prechargeable to a predetermined gaseous pressure.

In order to provide stability during flight through the air, the barrel of the syringe which has the single stopper may be provided with vanes or streamers.

The external projections of the skirt of the forward stopper may be external encircling rings. In such cases, the barrel is formed of a transparent or translucent material, whereby contact of such external encircling rings with the internal walls of the barrel may be observed, to assess the relative pressure of gas within the rearward propulsion chamber.

The propulsion chamber is controllably, variably prechargeable with a predetermined pressure of gas, e.g. air, before launching and impact, and is provided with means for self-sealing after such pressurization e.g. by the selection of the proper material for the stoppers.

The frangible septum may be formed of rubber or similar material, e.g. neoprene, silicone, urethane, etc.

The above-described syringes may be used with two specially designed needles. One embodiment of such needle of this invention comprises an open skirt, capped by a conical dome and a hollow hypodermic needle, pointed at both ends, fixedly secured in the conical dome. The skirt is preferably formed of a plastics material or of metal, while the needle is preferably formed of stainless steel.

The other embodiment of such needle of this invention is a releasing needle comprising: an open-ended, skirt-shaped cylindrical guide having its closed end pierced by a longitudinally extending channel; a hollow hypodermic needle temporarily secured within the cylindrical guide by means of a lower fixed disc attached to the hypodermic needle, the hypodermic needle being slidable within the cylindrical guide; a compressed recoil member, preferably a coil spring, disposed between the fixed lower disc and the cylindrical guide; and an upper, temporary, disintegratable disc, preferably formed of a water-soluble material which is adapted to dissolve slowly upon contact with water, the temporary disc being held in place by an impact frangible seal; whereby disintegration, i.e., dissolution, of the disc results in movement of the hypodermic needle into the cylindrical guide. The cylindrical guide may desirably be formed of a plastics material or of metal.

In each of these needles, penetration of the needle into the flesh of the animal is limited by the conical nose cone within which the needle is mounted. Each of these needles, moreover, may be provided with a safety cap temporarily and removably disposed over the hypodermic needle.

By one feature of the retracting collar of the invention, the recoil means preferably is a coil spring. The retracting collar may be formed of a plastics material or of metal.

The triggers are preferably provided with upper, inwardly sloped, bevelled surfaces, thereby to urge the triggers radially outwardly upon longitudinal movement of the suitably-shaped cooperating plunger member within the collar. The encircling retaining means preferably is an elastic retaining ring.

By one feature of the sliding fin assembly of this invention, three fins of triangular shape are preferably provided, which are preferably spaced 120° around the periphery of the collar, the fins preferably projecting from the collar at an angle of 90° to the tangent of the collar.

In one feature of the oral delivery device of this invention, the sleeve is provided with two such longitudinal slots. Preferably, the delivery means comprises a flexible tube connected to the free end of the hypodermic needle and terminating adjacent the hook or lure.

(iv) Generalized Description of the Invention

As described above, the present invention provides an "air-use" syringe and a "water-use" syringe. The air-use syringe ( a single stopper syringe) can be used either with the fixed needle (as described above) or with the releasing needle (also as described above). However, the fixed needle is the one which would more commonly be used in practice. The "air-use" syringe can be used in the collar described above which may be attached to a stick to prod an animal, or it may be used with the described collar on the end of a spear gun shaft the spear gun being operable in shallow water. Alternatively it may be shot from a gun or blowgun (with the addition of stabilizing tail feathers or streamers), it may be attached by way of the retracting collar to an arrow or crossbow bolt, or may simply be pushed against the target to initiate injection. It may be manufactured in a variety of sizes and both the dose and injection pressure can be varied. It is preferably equipped with a pressure-gauging stopper as described above, although a simple stopper may be used.

The "water-use" syringe (a two-stopper syringe) can be used in many of the same ways as the "air-use" syringe. It is, however, designed to be used in deep water where pressure compensation for depth must occur. In addition to being propelled at a target, it may be used with a hook and line device. Marking of aquatic animals or fish can be effected by incorporating a visualizable chemical compound, e.g., liquid latex or radioactive thorium dioxide, in the payload chamber of the syringe for deep intramuscular injection.

The fixed needle is generally useful for air use against a land animal or for water use where sedation and subsequent capture are the objects of such injection. The releasing needle, however, is especially designed to be used underwater, where the water-soluble material can dissolve to release the needle. It is particularly useful for delivering agents, e.g. hormones or antibiotics, where entrapment is not the object of such injection.

The fixed needle may be fitted with an absorbent material at the base of the outer needle such that it can be saturated with a marking dye. Such marking dye will leave a coloured spot at the site of the injection in order to identify which terrestrial animal has been treated, or in order to mark an animal for future treatment.

The retracting collar described above is specially designed to deliver the syringe and quickly and completely detach from it on impact with an aquatic or terrestrial animal in order to allow the animal to get away freely with the syringe attached. This prevents struggling which can cause stress and allows the required time for the injection to occur.

The sliding fin described above is specially designed to guide a spear gun shaft on a straighter path than has hitherto been possible while leaving the spear free to rotate. It is also valuable for use with standard or other special purpose spear tips.

BRIEF DESCRIPTION OF THE DRAWINGS

In the accompanying drawings.

Figure 1:
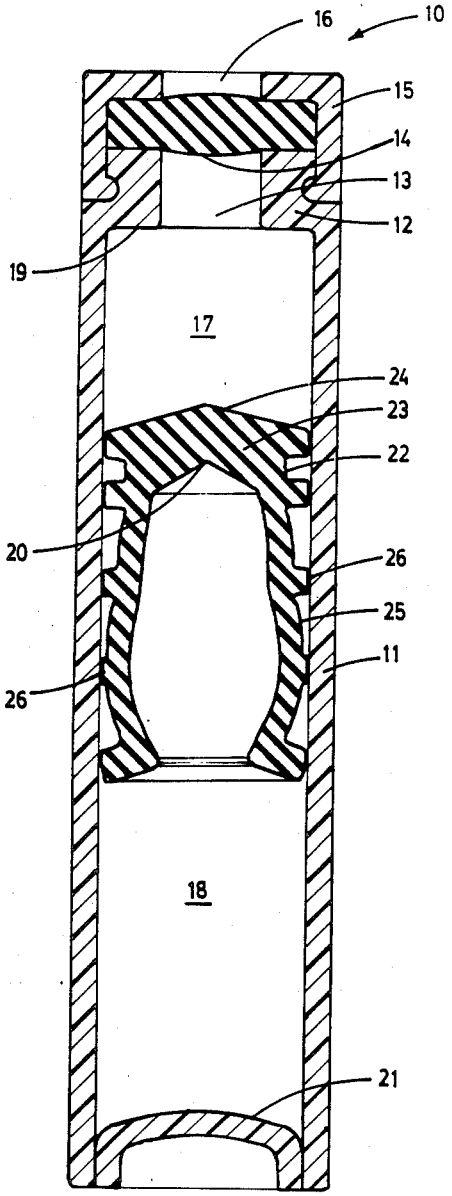
FIG. 1 is a central longitudinal cross-section of a syringe of a first embodiment of this invention, in its charged condition.

DESCRIPTION OF PREFERRED EMBODIMENTS (i) Decription of FIG. 1

As seen in FIG. 1, the syringe 10 includes a main barrel 11 having a closed end 12 provided with a central, longitudinally-extending, cylindrical channel 13 therethrough. Resting atop closed end 12 covering channel 13 is a pierceable elastic septum 14. The elastic septum 14 may be formed of natural or synthetic rubber, or silicone rubber, urethane, etc. The septum is held in place by a cap 15, the cap 15 being provided with a central, longitudinally-extending cylindrical channel 16, aligned with channel 13.

Within barrel 11 is a slidably disposed, rubber stopper 22, having a forward sealing plug 23 including a conical leading face 24 and a trailing cylindrical skirt 25 provided with a plurality of outer, circumferential, spaced-apart encircling rings 26. Stopper 22 divides the barrel 11 into a forward payload chamber 17, situated between the face 19 of the closed end 12 of the barrel 11, and the leading face 24 of the stopper 22, and a rearward propulsion chamber 18 situated between the trailing face 20 of the stopper 22 and the closed end 21 of the barrel 11.

While the stopper 22 has been shown to have a depending skirt, that feature is not essential to broad concepts of this invention, and consequently simple stopper without a depending skirt may be provided. Also, it is not essential to have a conical leading face.

Figure 2:
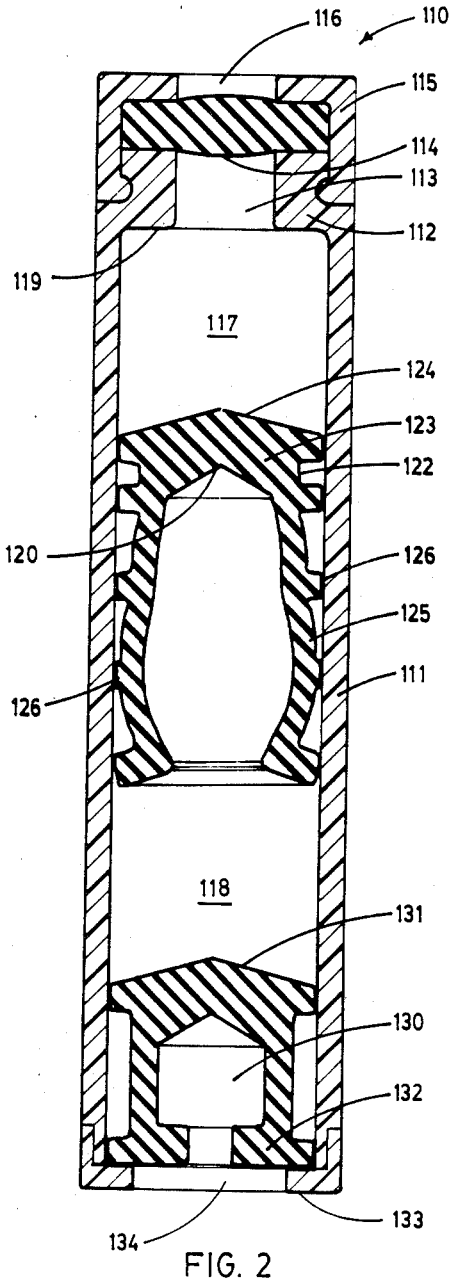
FIG. 2 is a central longitudinal cross-section of a syringe of a second embodiment of this invention, in its charged condition.

(ii) Description of FIG. 2

Another embodiment of this invention is shown in FIG. 2. As seen in FIG. 2, the syringe 110 includes a main barrel 111 having a closed end 112 provided with a central, longitudinally-extending, cylindrical channel 113 therethrough. Resting atop closed end 112 covering channel 113 is a piercable elastic septum 114. The elastic septum 114 may be formed of natural or synthetic rubber, or silicone rubber, urethane, etc. The septum 114 is held in place by a cap 115, the cap 115 being provided with a central, longitudinally-extending, cylindrical channel 116, aligned with channel 113.

Within barrel 111 is a slidably disposed rubber stopper 122, having a forward sealing plug 123 having a conical leading face 124 and a trailing cylindrical skirt 125 provided with a plurality of outer, circumferential, spaced-apart encircling rings 126. Also disposed within barrel 111 is a rear stoper 130. Stopper 130 includes a conical leading face 131 and a flat rear base 132, and is maintained within barrel 111 by means of a retaining ring 133 secured to the lower open end 134 of the barrel 111. Stoppers 122 and 130 divide the barrel 111 into a forward payload chamber 117, situated between the face 119 of the closed end 112 of the barrel 111, and the leading face 124 of the stopper 122, and rearward propulsion chamber 118, situated between the trailing face 120 of the stopper 122 and the leading face 131 of the rear stopper 130.

While the stopper 122 has been shown to have a depending skirt, that feature is not essential to broad concepts of this invention. Consequently stopper 122 may be in the form of a simple stopper without a depending skirt. Also, it is not essential for the stoppers 122 and 130 to have a concial leading face.

Two stoppers 122 and 130 are used in this embodiment in order to enable the syringe 110 to function under water. When the syringe is to be used under water, a means must be provided to equalize the hydrostatic pressure due to depth. An initial pressurized gas charge could become a relative vacuum unless the rear stopper 130 can freely move inwards as the pressure due to depth increases. By allowing this inward movement to occur, the original pressure difference is maintained and the motive force for the injection remains the same regardless of depth.

Figure 3:
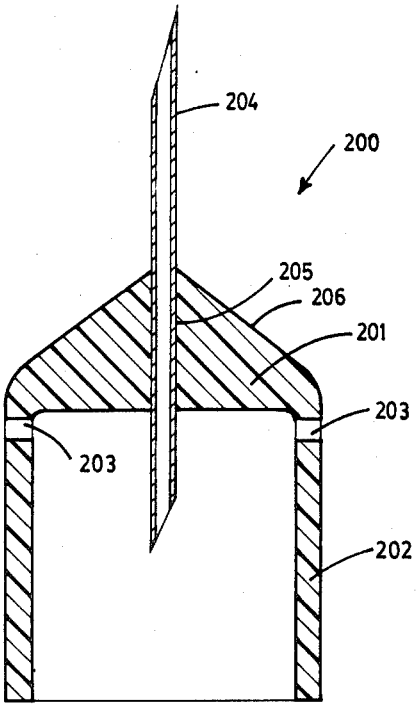
FIG. 3 is a central longitudinal cross-section of a fixed needle, usable with either of the syringes of FIGS. 1 or 2.
Figure 4:
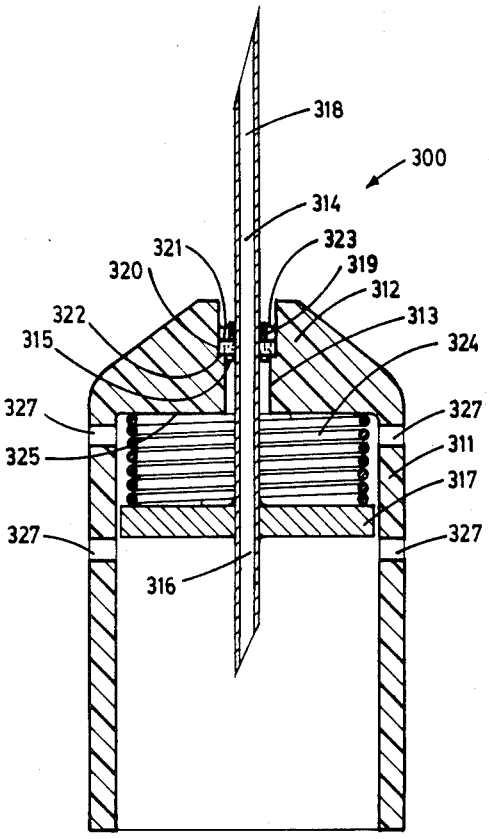
FIG. 4 is a central longitudinal cross-section of a releasing needle, usable with the syringes of either of FIGS. 1 or 2.

(iii) Description of FIG. 3 and 4

FIGS. 3 and 4 show two embodiments of needle structures which may be used with either of the embodiments of syringes shown in FIGS. 1 or 2. The fixed needle structure, 200, as seen in FIG. 3, includes an open-ended, inverted, cup-shaped member 201 having a depending skirt 202 including a pair of circumferential, pressure-equilization apertures 203 therein. A hollow, double-pointed needle 204 is fixed within a central longitudinal channel 205 within the conical nose 206 of the inverted member 201.

The releasing needle structure 300 as seen in FIG. 4 an inverted, cylindrical, cup-shaped guide tube 311 provided with a nose 312 pierced by an aperture 313 large enough to accommodate the hollow needle 314 and stop bushing 319. Needle 314 is secured, near its lower end 316 to a fixed disc 317 which is freely slidable within guide tube 311. Near the forward end 318 of the needle 314 is an annular stop bushing 319 fixed thereto. A water-soluble disintegratable split disc 320 has its upper face 321 abutting stop bushing 319 and its lower face abutting nose 312 at annulus 322 and sealed from water by frangible seals 323 and 315. A compressible recoil structure, e.g. coil spring 324 is held in compressed condition between the base 325 of the nose 312 and the upper face 326 of disc 317, since needle 318, which is secured to disc 317 is also secured within aperture 313. The guide tube 311 is provided with longitudinally-spaced-apart circumferential, pressure-equilization aperatures 327.

Figure 6:
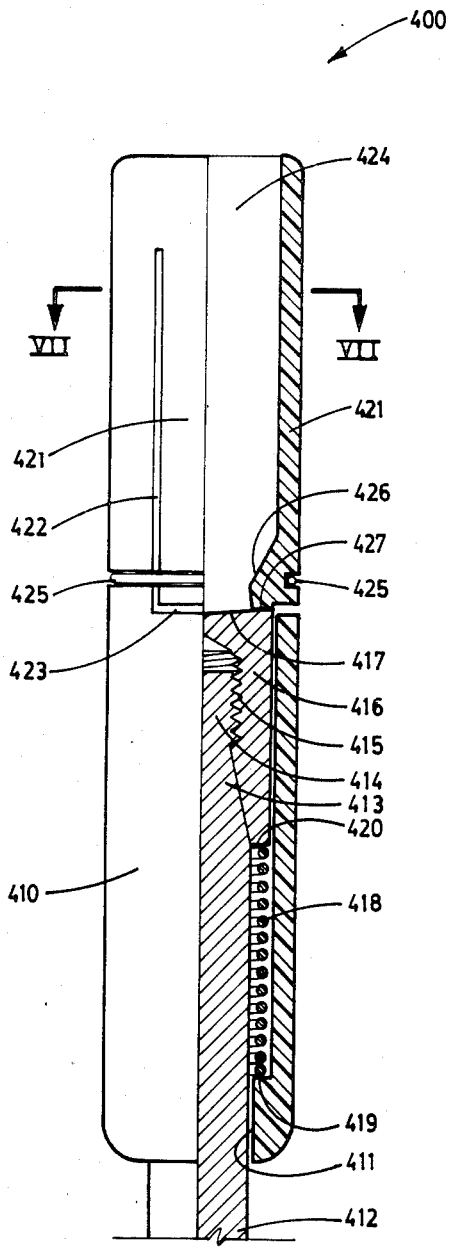
FIG. 6 is a partial longitudinal sectional, partial longitudinal elevational view of a retracting collar of one embodiment of this invention.
Figure 7:
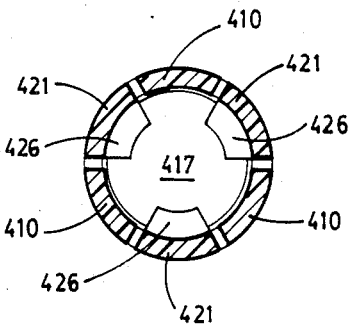
FIG. 7 is a section along the line VII—VII of FIG. 6.

(iv) Description of FIGS. 6 and 7

The syringes shown in the embodiment of FIG. 1 or in the embodiment of FIG. 2 may each be mounted in a retracting collar assembly associated with a spear shaft. One embodiment of such retracting collar assembly is shown in FIGS. 6 and 7.

As seen in FIGS. 6 and 7, the retractable collar indicated generally as 400 comprises a collar chamber 410, which has circular opening 411 at the rear end thereof therough which the forward end 413 of shaft 412 of a spear gun passes. The forward end 413 of the shaft 412 is threaded at 414 to engage with the tapped hollow end 415 of a plunger 416 provided with a concave end face 417. A coil spring member 418 is disposed between the inner shoulder 419 of the collar 410 and the lower annulus 420 of the plunger 416 around the shaft 412.

The upper end of collar 410 is provided with a plurality (in this case three) of integral spring triggers 421, each enclosed by continuous, parallel, longitudinal slits 422, joined by a transverse interconnecting slit 423. The triggers 421 are integrally connected to the collar 410 by an integral ring 424. Return to normal orientation of the triggers 421 where the triggers 421 are flush with the outer circumference of the collar chamber 410 is assisted by elastic retaining ring 425, (e.g. a rubber ring 425) which also ensures that a cooperating plunger member within the barrel is firmly gripped. The upper face of each of the triggers 421 is bevelled at 426, and terminates in a lower shoulder 427.

Figure 9:
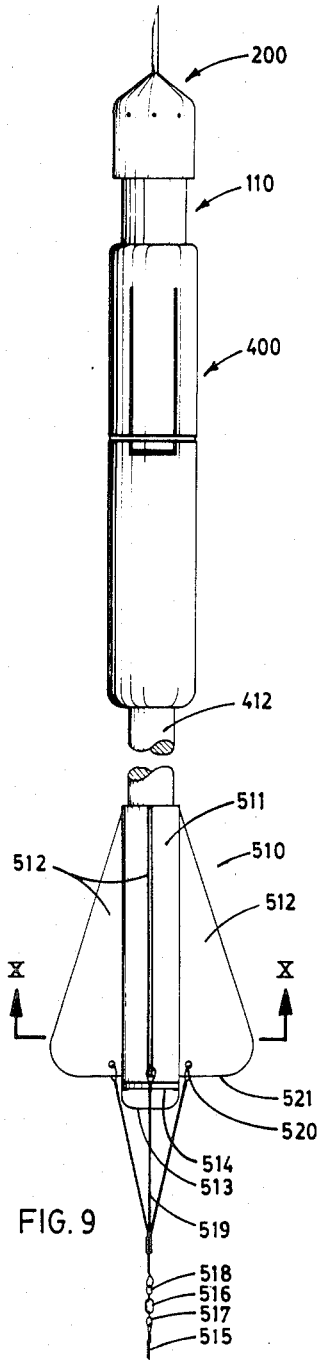
FIG. 9 is an elevational view of one embodiment of a syringe/retracting collar/sliding fin assembly of this invention.
Figure 10:
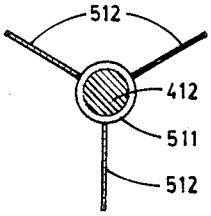
FIG. 10 is a section along the line X—X of FIG. 9.

(v) Description of FIGS. 9 and 10

The present invention also provides a novel sliding fin assembly. FIGS. 9 and 10 show such a novel sliding fin assembly in its preferred embodiment, in combination with a spear gun shaft bearing the retractable collar previously described in FIGS. 6 and 7 and with one of the syringes as previously described in FIGS. 1 and 2.

The sliding fin assembly 510 consists of the combination of a tubular collar 511 upon which are permanently disposed, at equiangular orientation and preferably projecting at right angles to the tangent of the collar (as shown in FIG. 10), a plurality (in this case three) of fins 512. Each fin 512 is generally triangular in shape. The tubular collar 511 is freely slidably disposed on the spear shaft 412. The rear end 513 thereof is provided with a movement-limiting stop ring 514.

The sliding fin assembly also includes an assembly to enable connection to a spear gun. Such connecting assembly comprises a lanyard 515, for connection to the spear gun in the usual manner, connected to a swivel member 516, by a proximal eye 517. The distal eye 518 is connected to a bridle 519 consisting of a line attached to a respective aperture 520 in the base 521 of each fin 512.

Figure 11:
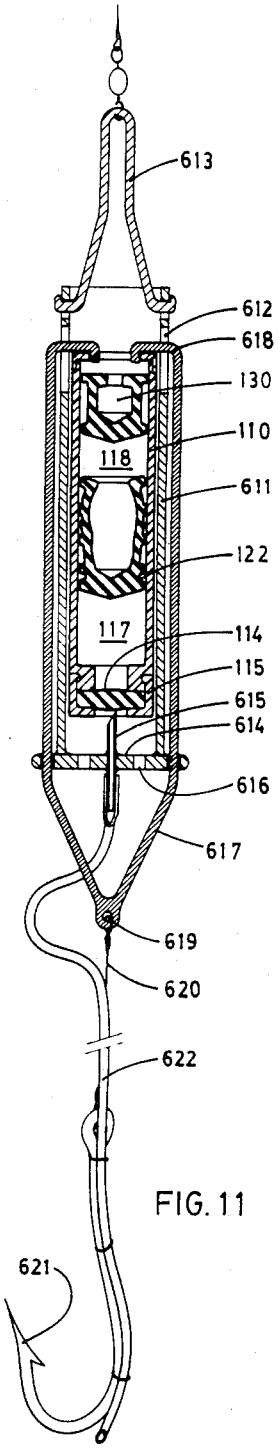
FIG. 11 is an elevational view of one embodiment of a syringe/hook or lure combination of this invention.

(vi) Description of FIG. 11

While the embodiments described above show the use of the syringe as a projectile, the syringe may alternatively, for example, be mounted in a sleeve interposed between a fishing line or hook or lure so that action of a fish pulling at the hook or lure would cause the septum to be punctured and a solution of chemical compound to be delivered orally by way of a tube leading from the needle to the hook and lure. One embodiment of such concept is shown in FIG. 11.

As shown in FIG. 11, the syringe 110 is held in a sleeve 611, which is provided with a plurality of longitudinal slots 612 (in this case two). The sleeve 611 is fitted with an upper hanger 613 by means of which it is connected to a fishing line in the usual manner. The sleeve 611 is also fitted with a lower base 614 provided with an inwardly pointed hypodermic needle 615 permanently attached at right angles thereto. Base 614 is provided with hydrostatic pressure relief apertures 616.

An operating yoke 617 is provided, having a plurality of prongs 618 (in this case two) each being slidably movable witin an associated slot 612. The yoke 617 terminates in a common attachment point 619, by which it is attached, by a non-elastic line 620 to a fish hook or lure 621.

The outer end of the hypodermic needle 615 is inserted in a conveying tube 622 whose open end terminates proximate to the hook or lure 621.

OPERATION OF PREFERRED EMBODIMENTS (i) Loading of Syringe of FIG. 1

As noted hereinabove, the syringes of FIGS. 1 or 2 may be fitted with either the needle of FIG. 3 or the needle of FIG. 4. The syringe of FIG. 1 may be loaded as follows:

In order to charge payload chamber 17 and propulsion chamber 18, the following steps are taken in sequence. The propulsion chamber 18 is pressurized to the degree desired by passing a hollow hypodermic needle (not shown) attached to a gas-filled syringe (also not shown) through the septum 14 and the stopper 22 and into the propulsion chamber 18. The gas (e.g. air) may then be injected into the propulsion chamber 18 to the desired pressure, and that hypodermic needle then withdrawn the puncture hole in the stopper 22 automatically sealing. The predetermined, exact amount of the liquid drug to be injected may then be loaded into another needle-equipped syringe (also not shown). That needle is passed only through the septum 14 and the drug is forced into the payload chamer 17, simultaneously displacing the stopper 22 and further compressing the gas in the propulsion chamber 18. The loading needle is withdrawn, the puncture hole in the stopper 22 automatically sealing, and the drug in the payload chamber 17 remains under pressure until use. These operations may be performed either by the operator or during manufacture of the syringe.

(ii) Loading of Syringe of FIG. 2

The syringe of FIG. 2 may be loaded as follows:

In order to charge payload chamber 117 and propulsion chamber 118 the following steps are taken: The predetermined exact amount of the liquid drug to be injected is loaded into a needle-equipped syringe (not shown). That needle is passed only through the septum 114 and the drug is forced into the payload chamber 117, simultaneously displacing the stopper 122. The loading needle is withdrawn, the puncture hole in septum 114 automatically sealing, and the drug remains in the payload chamber 117. The propulsion chamber 118 is then pressurized to the degree desired by passing a hollow hypodermic needle (not shown) attached to a gas-filled syringe (not shown) through the open core 134 of ring 133 and rear stopper 130. The gas (e.g. air) may then be injected into the propulsion chamber 118 to the desired pressure. When that hypodermic needle is then withdrawn, the puncture hole in stopper 130 automatically seals.

The amount of pressurization of the propulsion chamber (18 or 118) is easily determined. The cylindrical skirt (25 or 125) is deformable proportional to the pressure of gas causing it to bulge. Appropriately placed encircling rings (26 or 126) or other type of markings on the skirt (25 or 125) of the stopper (22 or 122) indicate the degree of internal pressure. At lower pressures, fewer such rings are in contact with the barrel (11 or 111) and at higher pressures, more such rings are in such contact. This can easily be seen through the transparent or translucent side walls of the barrel (11 or 111).

(iii) Operation of the Releasing Needle

Figure 5A:
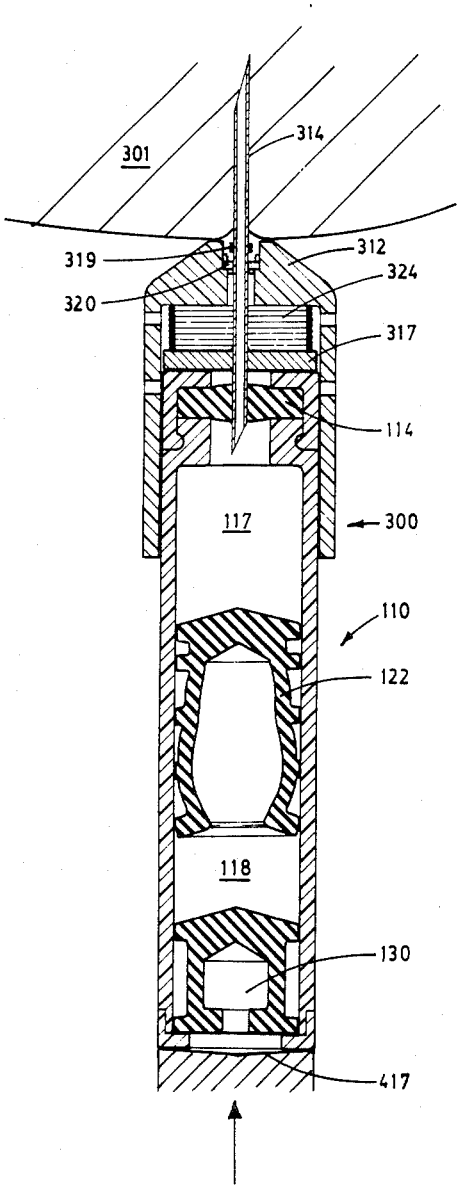
FIGS. 5A and 5B are central longitudinal cross-sections of a syringe of an embodiment of this invention with a needle of an embodiment of this invention, at the time of impact with the target animal and after injection is completed and the needle released, respectively.
Figure 5B:
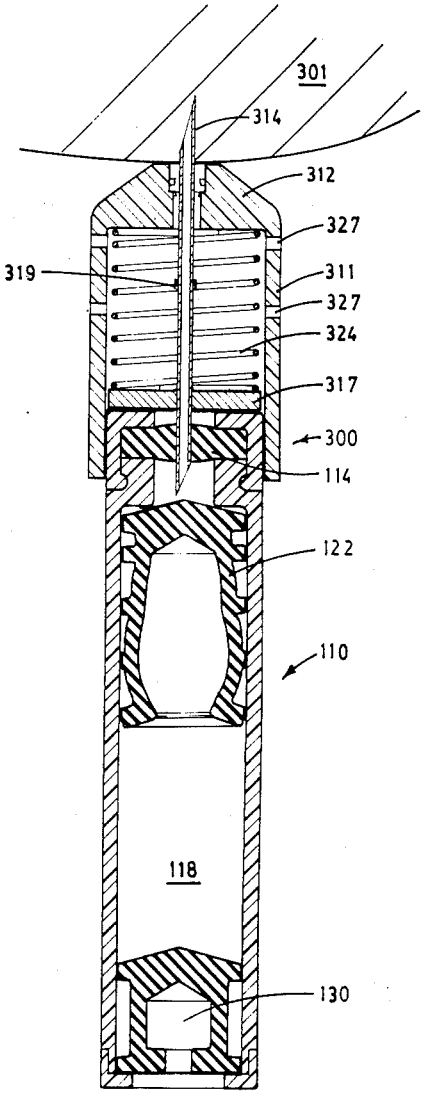

The operation of the releasing needle 300 can best be explained by reference to FIGS. 5A and 5B. FIG. 5A shows the embodiment of the syringe of FIG. 2 used with the releasing needle structure 300 of FIG. 4. In FIG. 5A the syringe/needle combination has just struck an aquatic animal and the needle has penetrated septum 114, causing the beginning of injection. Penetration of the needle 314 into the flesh 301 is limited by the conical nose 312 of needle 300. Needle 314 and fixed-disc 317 are momentarily thrust forward, completing the compression of the compressible recoil structure, e.g. spring 324. Because of that relative movement, frangible seals 315 and 323 are thus fractured allowing a small quantity of water to reach the water soluble disc 320 (see FIG. 4). Well after injection of chemical (not shown) from payload chamber 117 has been completed (see FIGS. 5B), the disc 320 will dissolve, allowing the pressure of the recoil structure, e.g. the spring 324, to force the cylindrical guide tube 311 forwardly, thus pushing the needle 314 out of the aquatic animal. The longitudinally-spaced-apart, circumferential, pressure-equilization apertures 327 allow such pushing action to take place by equilization of pressure on each side of the fixed disc 317, and also prevent cushioning by water as the syringe is forced rapidly forward, which would tend to interrupt such pushing action.

(iv) Operation of the Fixed Needle and Retracting Collar

Figure 8A:
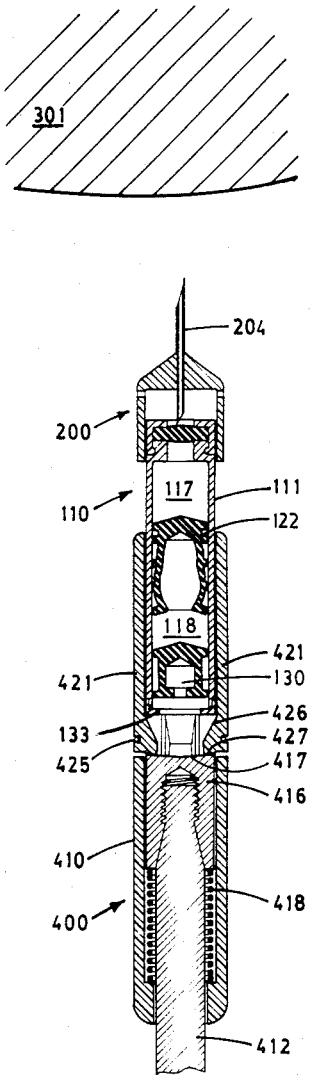
FIGS. 8A, 8B and 8C are central longitudinal cross-sections of a syringe of an embodiment of this invention with a needle of an embodiment of this invention, before impact with the target animal, at impact with the target animal, and after injection is completed and the retracting collar has released the syringe, respectively.
Figure 8B:
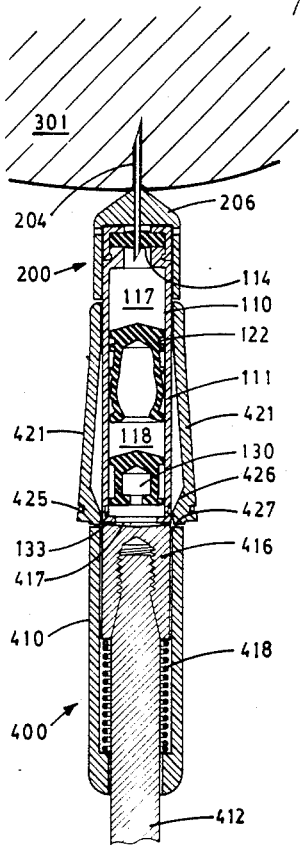
Figure 8C:
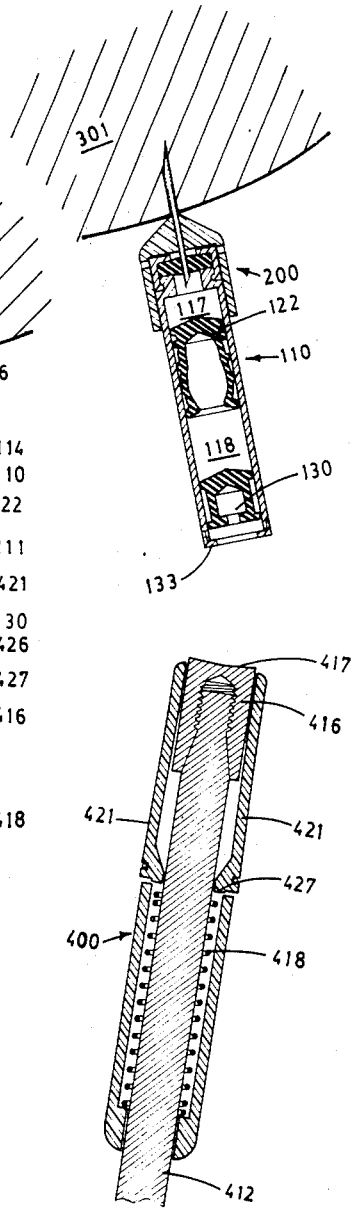

The operation of both the fixed needle 200 and the retracting collar 400 is best explained by references of FIGS. 8A, 8B and 8C. These figures show the embodiment of the syringe of FIG. 2 used with the fixed needle 200 of FIG. 3. As seen in FIG. 8A the syringe 110 is inserted in the upper end of the collar 410. The lower retaining ring 133 of the barrel 111 rests on the upper end of the bevels 426 of the triggers 421. In this orientation, the coil spring 418 is in its compressed (or "cocked") condition and the lower shoulders 427 of the triggers 421 are urged inwardly both by rubber retaining ring 425 and by their inherent springiness or resiliency.

As seen in FIG. 8B, when the combined syringe 110/retracting collar 400 strikes the target, the momentum drives the needle 204 through the septum 114 causing the beginning of the injection of the drug (not shown) within the payload chamber 117 into the target. Limit of penetration of the needle 204 into the flesh of the aquatic animal 301 is provided by conical nose 206. At the same time, the momentum drives the barrel 111 of the syringe 110 towards the plunger 416, with the retaining ring 133 moving along bevels 426 to urge triggers 421 outwardly. This results in the release of the previous engagement between the triggers 421 and the plunger 416 . Expansion of the spring 418 (se FIG. 8C) jettisons the retracting collar 410 which is now released from the syringe 110. This release allows unhindered injection of the drug.

(v) Operation of Sliding Fin Assembly

In use, the sliding fin assembly 510 is placed on spear shaft 412, and the spear gun is cocked in the normal manner. Upon firing, the sliding fin assembly 510 slides to the trailing end of the spear shaft 412 and is stopped by stop ring 514. The shape of fins 512 and the symmetry of the bridle 519 coupled with the rotational ability of the swivel 516 cause the spear to travel through the water with greater accuracy than was heretofore attainable.

(vi) Operation of Oral Delivery Device

In use, when a fish strikes the lure or bait mounted on the hook 621, the yoke 617 is urged downwardly. This tends to propel the syringe 110 downwardly. Since its downward travel is prevented by abutment of end cap 115 with end 614 of the sleeve 611, the inner pointed end of hypodermic needle 615 punctures septum 114, allowing the drug (not shown) to be propelled from payload chamber 117 along tube 622 to be delivered orally to the fish.

(vii) Generalized Description of Operation of the Invention

The syringes described herein may be adapted for use other than to inject a chemical compound into tissue. With modifications to the forward end of the sliding needle, impact from any motive force with a suitable firm object would cause the fluid in the payload chamber to be ejected. The "payload" could be any substance that the plunger will cause to be ejected through the needle. It could be a powder/air (gas) mix or a gas alone. The syringe cylinder is preferably made of a material sufficiently transparent so that the amount and condition of the fluid can be visually checked.

Delivery of the syringe to the target may be by any suitable means, e.g. propelled from a gun by an explosive charge or by compressed gas, or from a blowgun, in which case stabilizing vanes or tail feathers would be used to provide directional stability. The syringe may also be attached, in combination with the retracting collar, to an arrow or crossbow bolt fired through the air, or to a hand-held stick.

SUMMARY

From the foregoing description, one skilled in the art can easily ascertain the essential characteristics of this invention, and without departing from the spirit and scope thereof, can make various changes and modifications of the invention to adapt it to various usages and conditions. Consequently, such changes and modifications are properly, equitably, and "intended" to be, within the full range of equivalence of the following claims.

We claim;

1. A syringe comprising:

(a) a barrel having a closed forward end provided with a longitudinally extending channel therethrough;

(b) a hypodermic needle slidable received in said channel;

(c) a frangible septum disposed in said channel and adapted to be pierced upon inward sliding movement of said hypodermic needle; and, (d) at least a single stopper slidably and sealingly disposed in said barrel to divide said barrel into (i) a forward, payload chamber, defined between the closed forward end of said barrel and the leading face of the stopper and (ii) a rearward propulsion chamber downstream of the trailing face of said stopper, said propulsion chamber being prechargeable to a controllable, variable, predetermined gaseous pressure, and wherein said hypodermic needle is a releasing needle structure comprising: an open-ended, skirt-shaped guide having a closed end pireced by a longitudinally-extending channel; a hollow hypodermic needle temporarily secured within said guide by means of a lower fixed disc attached to said needle, said hypodermic needle being adapted to be slidable within said guide; a compressed recoil member disposed between said fixed disc and said guide; and an upper, temporary, disintegratable disc held in place by an impact frangible seal; whereby disintegration of said disc results in movement of said needle into said cylindrical guide.

2. The syringe of claim 1, including a safety cap temporarily and removable disposed over said hypodermic needle.

3. A syringe comprising:

(a) a barrel having a closed forward end provided with a longitudinally extending channel therethrough;

(b) a hypodermic needle slidable received in said channel;

(c) a frangible septum disposed in said channel and adapted to be pierced upon inward sliding movement of said hypodermic needle; and, (d) at least a single stopper slidably and sealingly disposed in said barrel to divide said barrel into (i) a forward, payload chamber, defined between the closed forward end of said barrel and the leading face of the stopper and (ii) a rearward propulsion chamber downstream of the trailing face of said stopper, said propulsion chamber being prechargeable to a controllable, variable, predetermined gaseous pressure, and wherein said hypodermic needle structure is a releasing needle comprising: an open-ended, skirt-shaped cylindrical guide having its closed end pierced by a longitudinally extending channel; a hollow hypodermic needle temporarily secured within said cylindrical guide by means of a lower fixed disc attached to said hypodermic needle, said hypodermic needle being adapted to be slidable within said cylindrical guide; a compressed coil spring disposed between said fixed disc and said cylindrical guide; and an upper, temporary, disintegratable disc held in place by an impact frangible seal; whereby disintegration of said disc results in movement of said hypodermic needle into said cylindrical guide.

4. The syringe of claim 3, including a safety cap temporarily and removably disposed over said hypodermic needle.

5. A syringe comprising:

(a) a barrel having a closed forward end provided with a longitudinally extending channel therethrough;

(b) a hypodermic needle slidable received in said channel;

(c) a frangible septum disposed in said channel and adapted to be pierced upon inward sliding movement of said hypodermic needle; and, (d) at least a single stopper slidably and sealingly disposed in said barrel to divide said barrel into (i) a forward, payload chamber, defined between the closed forward end of said barrel and the leading face of the stopper and (ii) a rearward propulsion chamber downstream of the trailing face of said stopper, said propulsion chamber being prechargeable to a controllable, variable, predetermined gaseous pressure, and wherein said hypodermic needle is a releasing needle structure comprising: an open-ended, skirt-shaped cylindrical guide formed of a plastics material and having its closed end pierced by a longitudinally extending channel; a hollow hypodermic needle temporarily secured within said cylindrical guide by means of a lower fixed disc attached to said hypodermic needle, said hypodermic needle being adapted to be slidable within said cylindrical guide; a compressed coil spring disposed between said fixed disc and said cylindrical guide; and an upper, temporary, disc formed of a water-soluble material adaptable to dissolve slowly upon contact with water, said temporary disc being held in place by an impact frangible seal; whereby dissolution of said disc results in movement of said hypodermic needle into said cylindrical guide.

6. The syringe of claim 5, including a safety cap temporarily and removable disposed over said hypodermic needle.

7. A syringe comprising:

(a) a barrel having a closed forward end provided with a longitudinally extending channel therethrough;

(b) a hypodermic needle slidable received in said channel;

(c) a frangible septum disposed in said channel and adapted to be pierced upon inward sliding movement of said hypodermic needle; and, (d) at least a single stopper slidably and sealingly disposed in said barrel to divide said barrel into (i) a forward, payload chamber, defined between the closed forward end of said barrel and the leading face of the stopper and (ii) a rearward propulsion chamber downstream of the trailing face of said stopper, said propulsion chamber being prechargeable to a controllable, variable, predetermined gaseous pressure, and wherein said hypodermic needle is a releasing needle structure comprising: an open-ended, skirt-shaped cylindrical guide formed of metal and having its closed end pierced by a longitudinally extending channel; a hollow hypodermic needle temporarily secured within said cylindrical guide by means of a lower fixed disc attached to said hypodermic needle, said hypodermic needle being adapted to be slidable within said cylindrical guide; a compressed coil spring disposed between said fixed disc and said cylindrical guide; and an upper, temporary, disc formed or a water-soluble material adaptable to dissolve slowly upon contact with water, said temporary disc being held in place by an impact frangible seal; whereby dissolution of said disc results in movement of said hypodermic needle into said cylindrical guide.

8. The syringe of claim 7, including a safety cap temporarily and removably disposed over said hypodermic needle.

* * * * *